US007441779B2

(12) United States Patent
Hoeting

(10) Patent No.: US 7,441,779 B2
(45) Date of Patent: Oct. 28, 2008

(54) GAME PIECE

(75) Inventor: Stephen C. Hoeting, Maineville, OH (US)

(73) Assignee: Designomite, L.L.C., Maineville, OH (US)

( * ) Notice: Subject to any disclaimer, the term of this patent is extended or adjusted under 35 U.S.C. 154(b) by 147 days.

(21) Appl. No.: 11/355,686

(22) Filed: Feb. 16, 2006

(65) Prior Publication Data

US 2007/0187891 A1 Aug. 16, 2007

(51) Int. Cl.
*A63F 3/00* (2006.01)

(52) U.S. Cl. ..... 273/288; 273/148 R

(58) Field of Classification Search ..... 473/286; 294/19.2; 273/288, 290, 148 R
See application file for complete search history.

(56) References Cited

U.S. PATENT DOCUMENTS 1,937,828 A * 12/1933 MacDonald ..... 294/19.2
2,760,807 A * 8/1956 Watson ..... 294/19.2
D187,600 S * 4/1960 Felker ..... D21/721
3,822,720 A * 7/1974 Souza ..... 137/846
4,019,746 A 4/1977 Hare
4,058,336 A * 11/1977 Parkinson ..... 294/19.2
4,341,239 A * 7/1982 Atkinson ..... 137/493
4,385,764 A 5/1983 Bhatti
4,434,810 A * 3/1984 Atkinson ..... 137/493
4,448,421 A 5/1984 Zaruba et al.
4,497,491 A 2/1985 Holman
4,813,678 A 3/1989 Collazo et al.
4,846,836 A * 7/1989 Reich ..... 623/23.68
5,037,150 A * 8/1991 Vecchi ..... 294/19.2
5,472,208 A 12/1995 Berry
5,755,632 A * 5/1998 Eddy ..... 473/460

* cited by examiner

*Primary Examiner*—Vishu K. Mendiratta
(74) *Attorney, Agent, or Firm*—Wood, Herron & Evans, L.L.P.

(57) ABSTRACT

A game piece for transferring an object across the surface of a board game or the like. The game piece generally comprises a carrier body having an upper end, a lower end, an entry opening proximate the lower end, and a socket in communication with the entry opening. The entry opening is sized to allow the transfer object to pass therethrough so that the transfer object is thereafter retained within the socket. Additionally, the socket is adapted to receive a second game piece having a similarly configured socket and entry opening. When the entry opening of the second game piece is pushed over the transfer object, the object is transferred from the socket of the original game piece to the socket of the second game piece.

12 Claims, 11 Drawing Sheets

GAME PIECE

FIELD OF THE INVENTION

The present invention relates generally to game pieces, and more particularly to a game piece for use with a transfer object.

BACKGROUND OF THE INVENTION

Board games and other similar toys have proven to be extremely successful and long-lasting products. As a result, a wide variety of board games exist in the marketplace. Many of these games typically involve moving one or more game pieces to various spaces on a playing surface. For example, in the game of Monopoly, a user can select from various different types of game pieces including a dog, car, iron, shoe, and other objects. These game pieces are advanced across the playing surface or game board by rolling a set of dice and moving the pieces a corresponding number of spaces. In other board games, game pieces are advanced across the playing surface by spinning a wheel with numerical values, answering certain questions with point values correctly, or some other method specified in the rules of the game.

Manufacturers are constantly seeking new and creative ways to entertain consumers with board games. Although many different types of board games and game pieces exist, very few of these game pieces are designed to do anything more than travel across the game's playing surface. New games and new forms of entertainment would be possible if game pieces were designed to achieve additional functions.

SUMMARY OF THE INVENTION

A game piece for use with a transfer object comprises a carrier body having an upper end and a lower end, an entry opening proximate the lower end, and a socket in communication with the entry opening. The entry opening is sized to allow the transfer object to pass therethrough so that the transfer object is thereafter retained within the socket. Additionally, the socket is adapted to receive a second game piece having a similarly configured socket and entry opening. When the entry opening of the second game piece is pushed over the transfer object retained in the first game piece, the transfer object passes through the entry opening of the second game piece so as to be transferred from the socket of the first game piece to the socket of the second game piece.

The carrier body of the game piece may be configured to nest with the second game piece. This enables the second game piece to be stacked on top of the first game piece when transferring or "capturing" the object therefrom. Additionally, the game piece may incorporate various safety features to prevent a person from having his or her finger get caught in the entry opening. For example, the socket may include a cut-out portion or the carrier body may be constructed from separate, detachable components.

Alternative game pieces incorporating the general principles of the invention are also disclosed. By having the ability to capture objects from a playing surface or an opponent's game piece, new and entertaining types of board games may be created with these game pieces.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
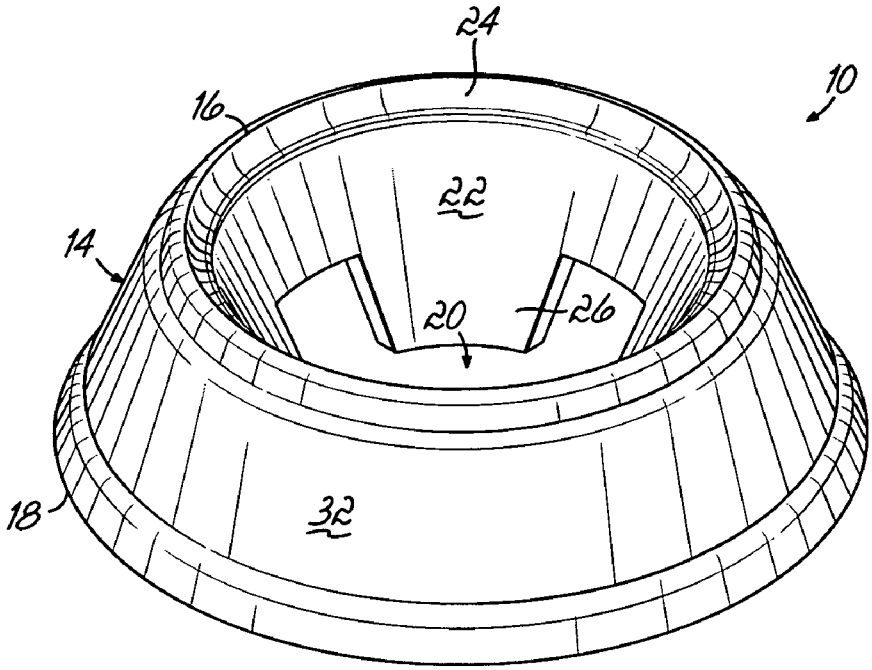
FIG. 1 is a perspective view of a game piece according to one embodiment of the invention.
Figure 2:
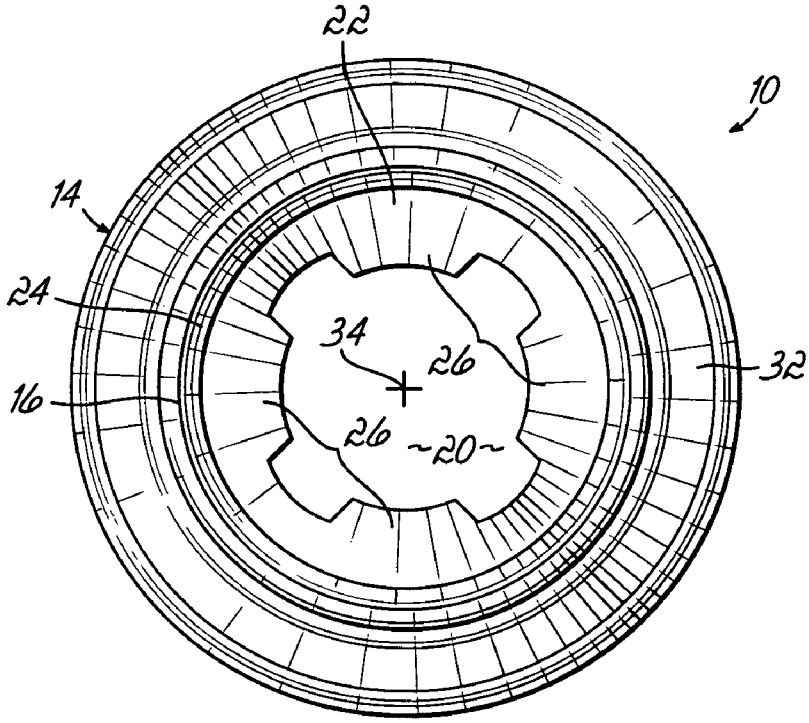
FIG. 2 is a top view of the game piece shown in FIG. 1.

With reference to FIGS. 1 and 2, a game piece 10 according to one embodiment of the invention is shown. The game piece 10 may be used in connection with any game played on a game board or similar playing surface. As will be described in greater detail below, the game piece 10 is designed to capture a transfer object 12 (FIG. 3) from the playing surface or another game piece.

Figure 11:
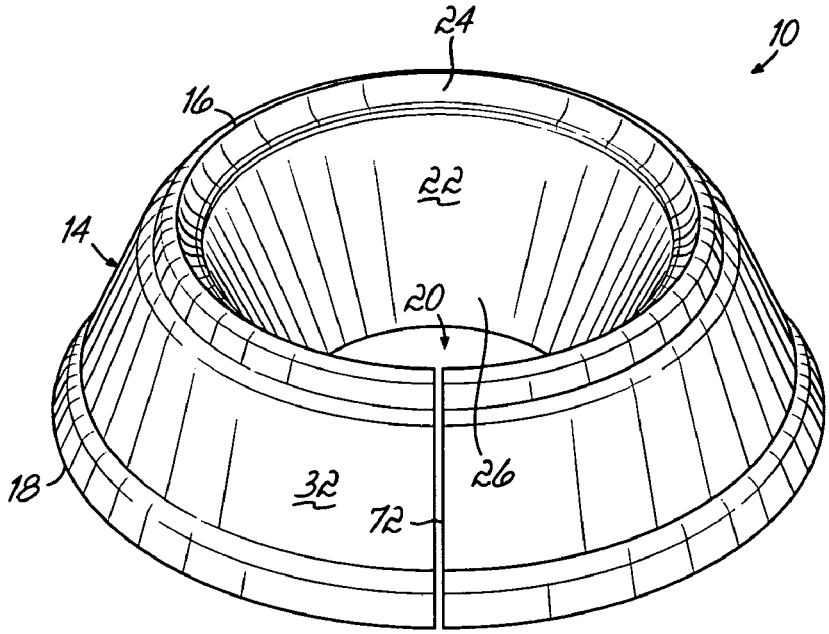
FIG. 11 is a perspective view showing another embodiment of a game piece having a cut-out portion.

The game piece 10 generally comprises a carrier body 14 having an upper end 16 and a lower end 18, an entry opening 20 proximate the lower end 18, and a socket 22 communicating with the entry opening 20. The socket 22 also communicates with an exit opening 24 proximate the upper end 16. Because the exit opening 24 has a larger diameter than the entry opening 20, the socket 22 is substantially conical. Additionally, the socket 22 includes one or more flexible members 26 that define at least a portion of the entry opening 20. As shown in FIG. 11, a single flexible member 26 may be provided to define the entire entry opening 20.

Figure 3:
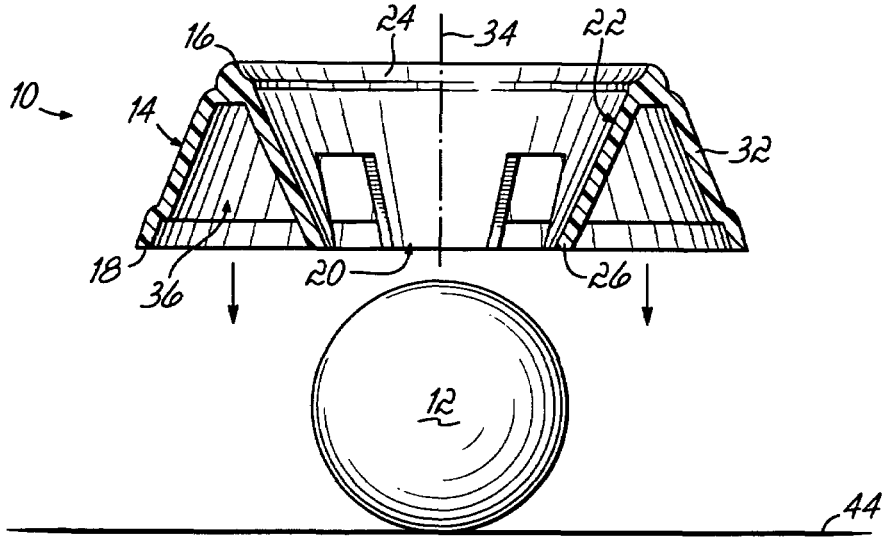
FIGS. 3-6 are cross-sectional side views showing the game piece of FIG. 1 being used to capture a transfer object.

An outer wall 32 of the carrier body 14 extends from the upper end 16 to the lower end 18 and surrounds the socket 22. Both the outer wall 32 and socket 22 are arranged about a central axis 34 such that the carrier body 14 is axis-symmetric. And as shown in FIG. 3, the outer wall 32 extends downwardly and outwardly from the upper end 16 such that the carrier body 14 has a frustoconical profile. A cavity 36 is provided in the carrier body 14 between the socket 22 and outer wall 32.

FIGS. 3 through 6 illustrate the game piece 10 being used to capture a transfer object 12 located on a game board or playing surface 44. Although the transfer object 12 is shown as being spherical, those skilled in the art will appreciate that the transfer object 12 may have other shapes and configurations.

Figure 4:
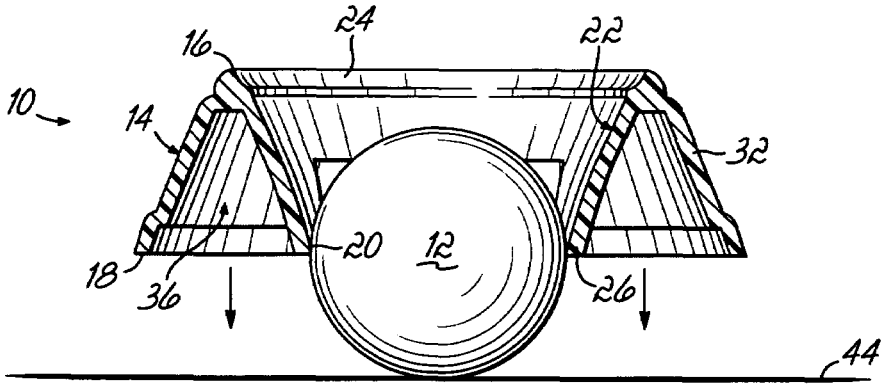
Figure 5:
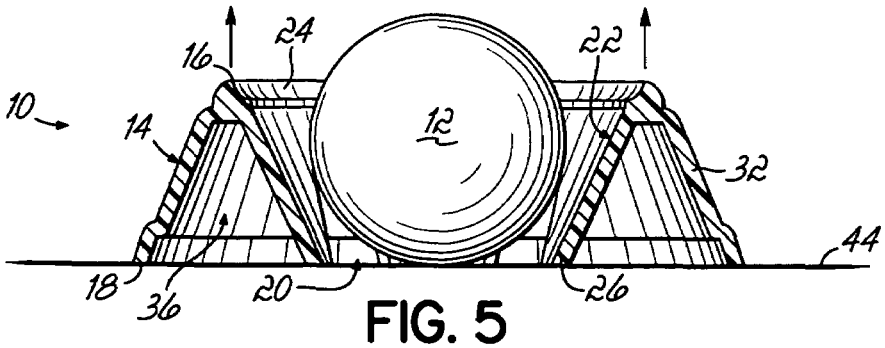
Figure 6:
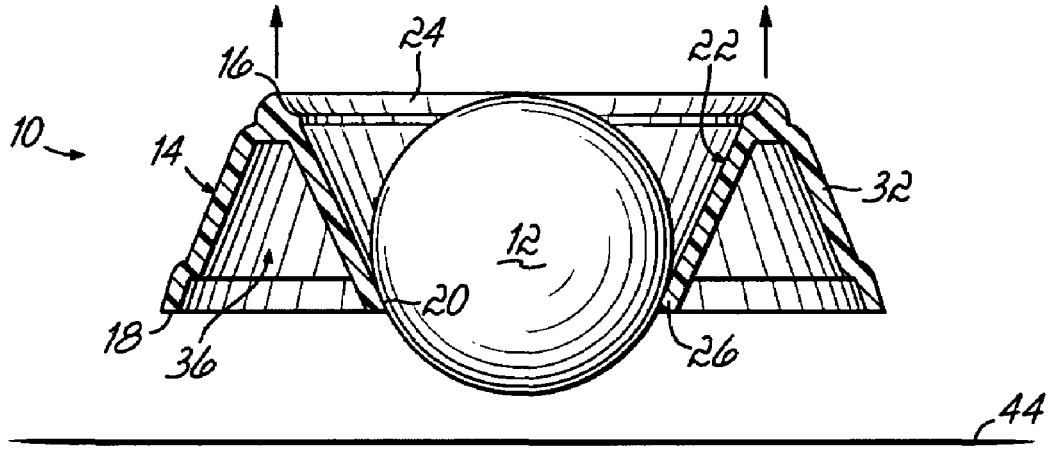

In use, the game piece 10 is positioned above the playing surface 44 with the entry opening 20 generally aligned over the transfer object 12. When a player desires to "pick-up" or capture the transfer object 12, he or she pushes the game piece 10 over the transfer object 12. The entry opening 20 is sized to allow the transfer object 12 to pass therethrough so that the transfer object 12 is thereafter retained in the socket 22. As shown in FIG. 4, the flexible members 26 that define the entry opening 20 are deflected outwardly as the game piece 10 is pushed over the transfer object 12. As shown in FIGS. 1-3, the flexible members 26 are spaced apart from one another such that they may deflect independently of one another. This deflection enables the entry opening 20 to expand to accommodate the transfer object 12. When the transfer object 12 has passed through the entry opening 20, the flexible members 26 deflect inwardly to their initial position so that the transfer object 12 is "captured" or retained within the socket 22. As shown in FIG. 6, the game piece 10 may then be lifted, slid, or otherwise shifted across the game board surface 44 to move the transfer object 12 to another location.

Figure 7:
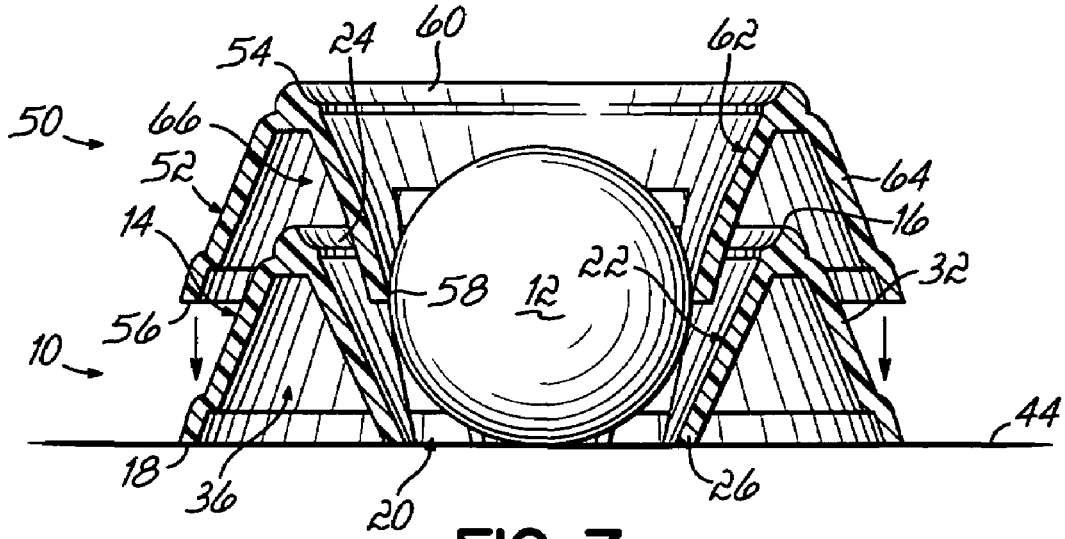
FIGS. 7-9 are views similar to FIGS. 3-6 showing a second game piece interacting with the game piece of FIG. 1 to capture the transfer object.

In one embodiment, the shape of the cavity 36 generally corresponds to the profile defined by the socket 22 and outer wall 32. Accordingly and with reference to FIGS. 7-9, the game piece 10 is adapted to receive or nest with a second game piece 50 having a similarly configured carrier body. Like the game piece 10, the second game piece 50 includes a carrier body 52 having an upper end 54 and a lower end 56, an entry opening 58 and an exit opening 60, a socket 62 in communication with the entry and exit openings 58, 60, and an outer wall 64 extending between the upper and lower ends 54, 56. The outer wall 64 also surrounds the socket 62 and is angled away from the socket 62 so as to create a cavity 66 therebetween.

To capture the transfer object 12 from the game piece 10, the second game piece 50 is positioned with the entry opening 58 above the transfer object 12. When the entry opening 58 is pushed over the transfer object 12, the transfer object 12 is captured by or transferred to the socket 62 in the same manner that was described with reference to the socket 22 in FIGS. 3-6. In other words, the transfer object 12 is transferred from the socket 22 of the game piece 10 to the socket 62 of the second game piece 50 so as to reside therein. Once the transfer object 12 has been captured by the second game piece 50, the second game piece 50 may be removed from the first game piece 10 and placed elsewhere on the game board surface 44.

Figure 8:
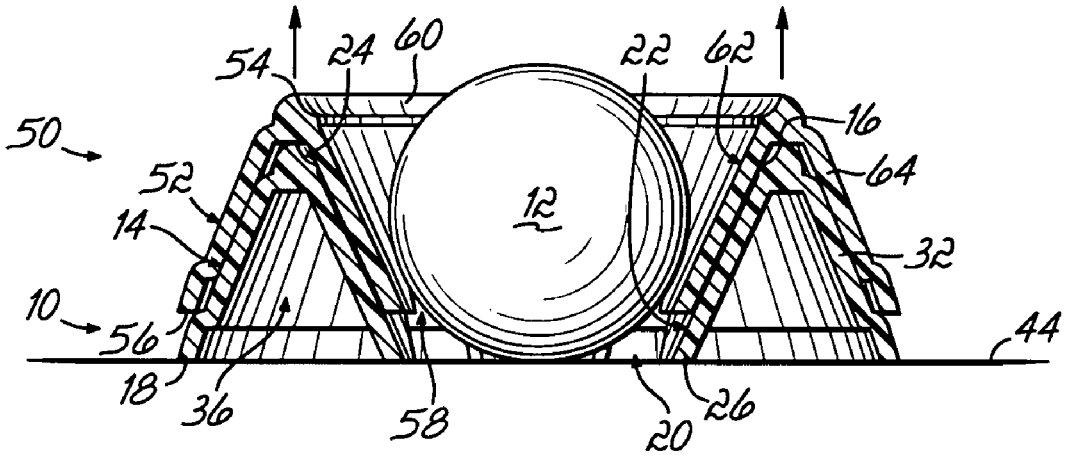
Figure 9:
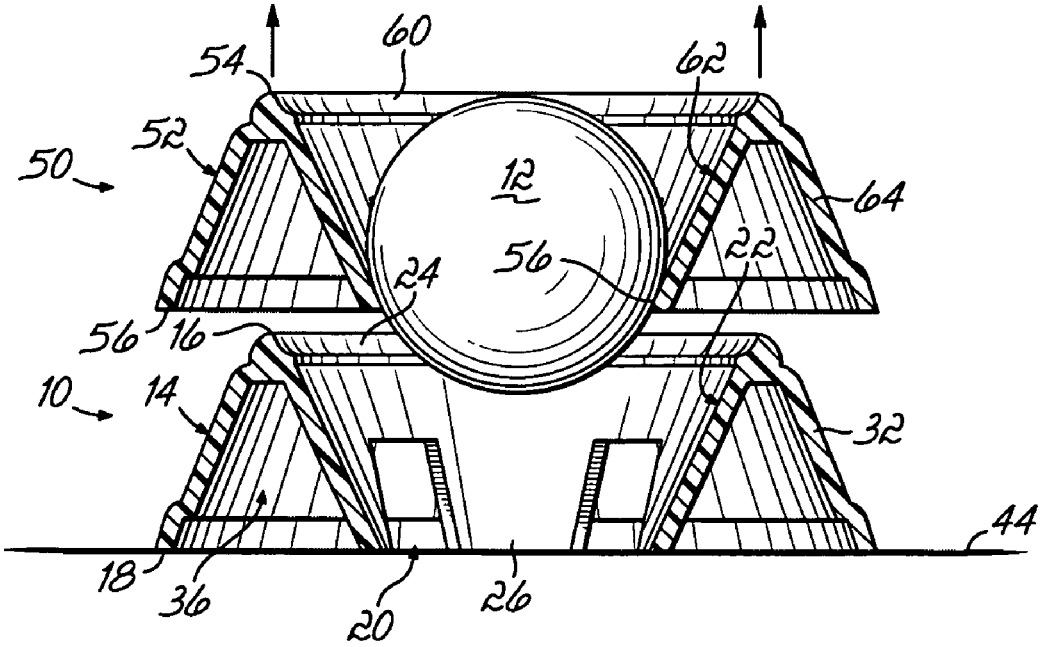

FIG. 8 shows how the game pieces 10, 50 are advantageously adapted to nest with each other. Specifically, the socket 22 and outer wall 32 of the game piece 10 are adapted to be received in the cavity 66 of the second game piece 50. The game pieces therefore have the ability to be stacked on top of each other. Thus, a third game piece (not shown) with a similarly configured carrier body could be pushed on top of the second game piece 50 to capture the transfer object 12 and increase the overall height of the stacked pieces.

The ability to capture and transfer objects creates new possibilities for entertaining board games. For example, rather than simply moving a game piece to particular spaces on the game board, a board game may be designed where players must travel across various spaces, collect certain objects, and bring the objects back to a "base" or some other designated location. The game may involve additional strategy by allowing players to steal or capture the objects being transferred by their opponents. Therefore, the game pieces 10, 50 could be used to provide fun and exciting board games beyond those using traditional game pieces.

Figure 10:
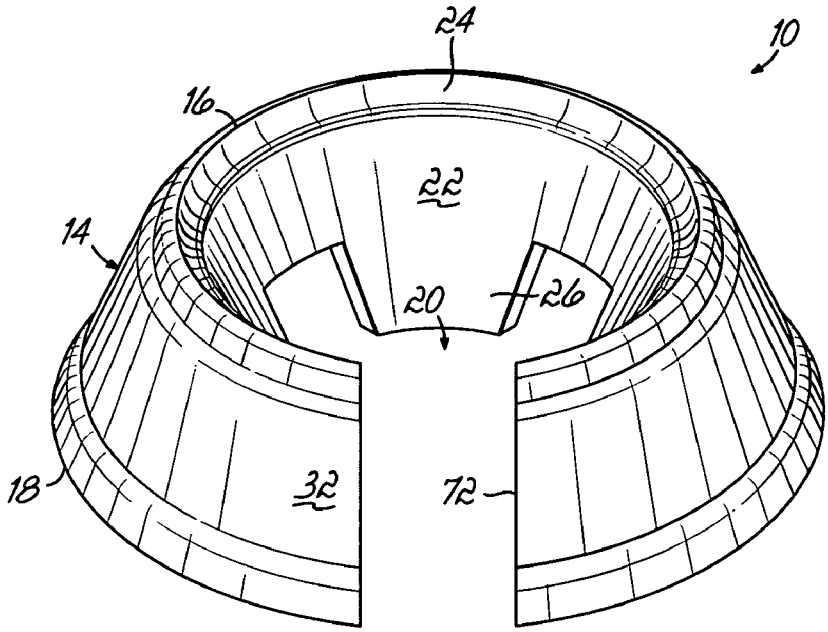
FIG. 10 is a perspective view showing one embodiment of a game piece having a cut-out portion.

With reference to FIGS. 10 and 11, the game piece 10 may further include a cut-out portion 72 through the socket 22 and outer wall 32. The cut-out portion 72 may be a substantial gap (FIG. 10) or a small slot (FIG. 11). Either way, the cut-out portion 72 serves as a safety feature. For example, if a player were to inadvertently insert his or her finger through the socket 22 and entry opening 20, he or she may have difficulty pulling it back through entry opening 20. The cut-out portion 72 ensures that tension between the player's finger and the game piece 10 can be released by expanding the entry opening 20. If the game piece 10 is constructed from flexible material, such as plastic, the cut-out portion 72 may also be enlarged by pulling the carrier body 14 in opposite directions so that the player can remove his or her finger through the corresponding gap or slot.

Figure 12:
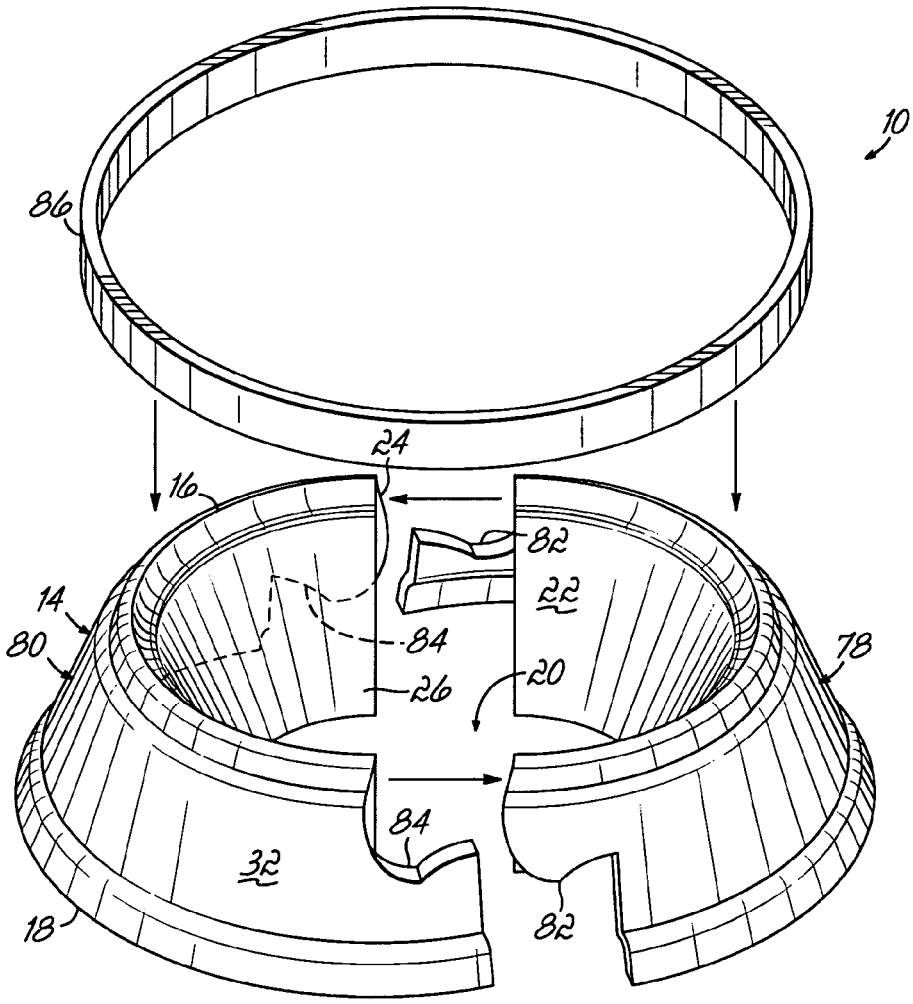
FIG. 12 is an exploded perspective view showing one embodiment of a game piece having multiple sections.
Figure 13:
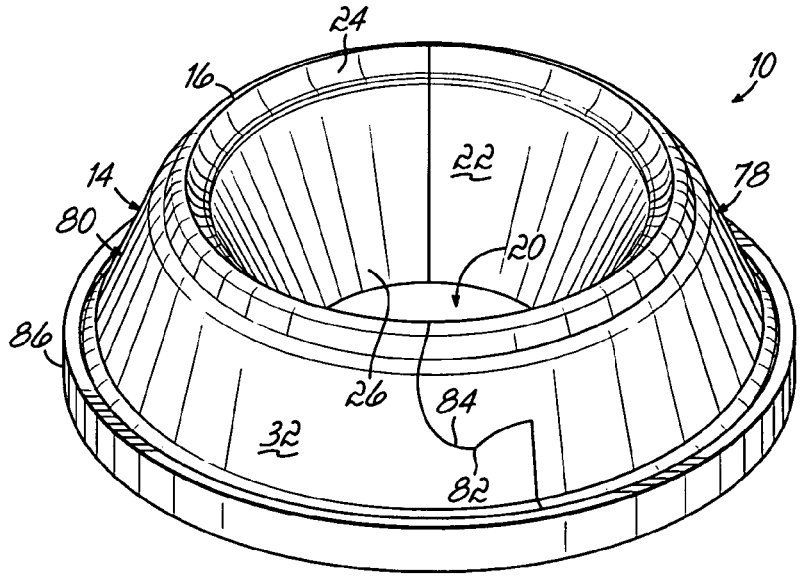
FIG. 13 is a perspective view of the game piece shown in FIG. 12.

FIGS. 12 and 13 illustrate an alternative embodiment of the game piece 10. In this embodiment, the carrier body 14 is comprised of first and second sections 78, 80 each defining at least a portion of the outer wall 32 and socket 22. The first and second sections 78, 80 are adapted to be coupled to each other. To this end, the first section 78 includes projections 82 that engage corresponding notches 84 in the second section 80. A ring member 86 may be provided around the perimeter of the outer wall 32 to further facilitate and promote coupling the first section 78 to the second section 80. Like the embodiment in FIGS. 10 and 11, such an arrangement serves as a safety feature. If needed, players could readily remove the ring member 86 and uncouple or detach the first and second sections 78, 80 to release a finger caught in the entry opening 20.

Figure 14:
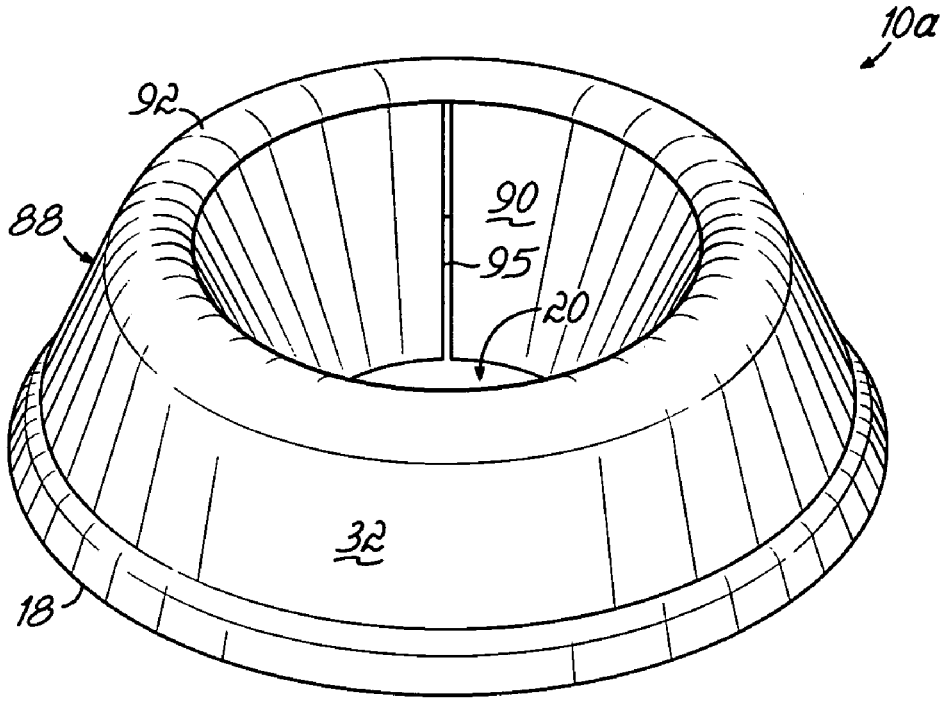
FIG. 14 is a perspective view showing another embodiment of a game piece having multiple components.
Figure 15:
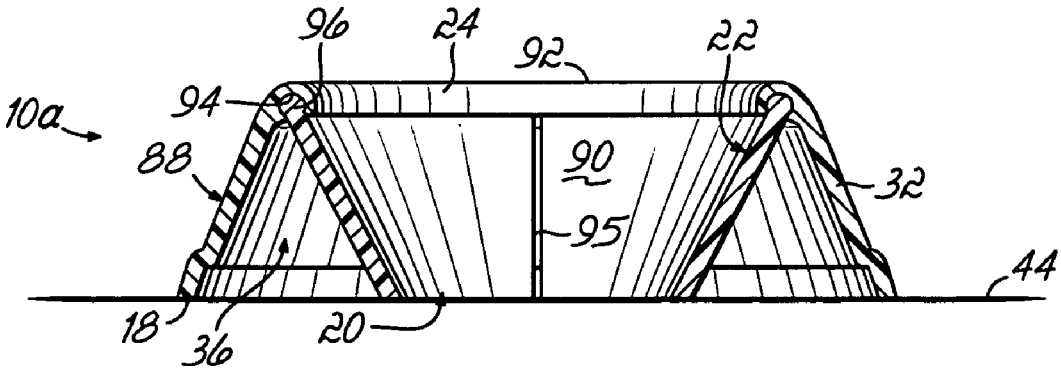
FIG. 15 is a cross-sectional side view of the game piece shown in FIG. 14.

In the embodiment in FIGS. 14 and 15, a game piece 10*a* is comprised of a carrier body 88 and a removable insert 90. Carrier body 88 includes an upper end 92 having a recess 94. The removable insert 90 includes a cut-out portion 95 and a rim member 96 that can be removably inserted into and retained by the recess 94 such that the carrier body 88 and insert 90 form unitary game piece 10*a*. With the removable insert 90 put together with carrier body 88, the game piece 10*a* has many of the same features as the game piece 10 in FIG. 1, such as the lower end 18, the entry opening 20, the socket 22, the exit opening 24, the outer wall 32, and the cavity 36. The recess 94 is configured to retain the insert 90 when a transfer object disposed within the socket 22 when game piece 10*a* is lifted off the game board surface 44. The insert 90, however, can be removed from the carrier body 88 when necessary. For example, if a player gets his or her finger caught in the entry opening 20, he or she can pull the carrier body 88 away from the insert 90 to separate the two components. The player can then release any tension between his or her finger and the insert 90 by expanding the cut-out portion 95 and the entry opening 20.

Figure 16:
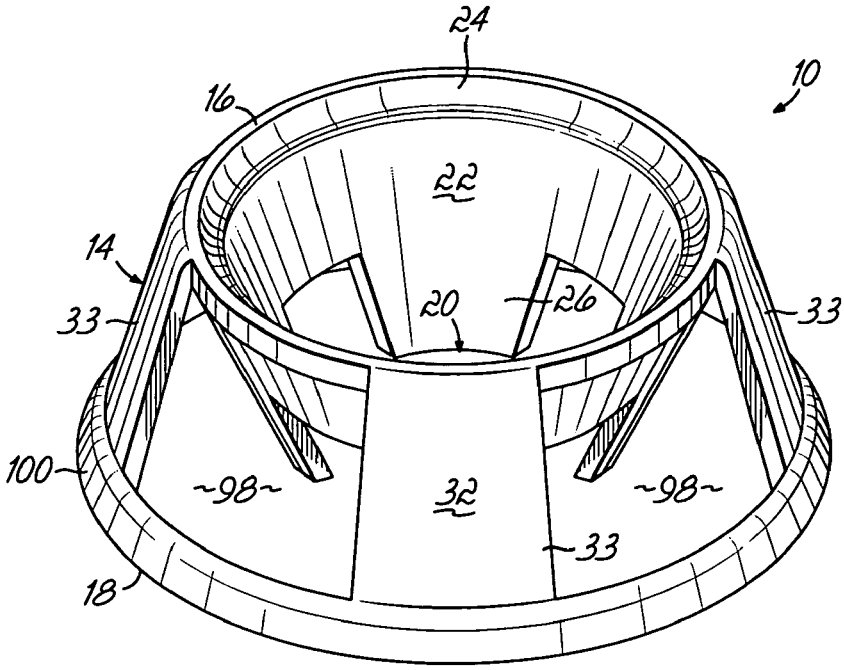
FIG. 16 is a perspective view similar to FIG. 1 showing another embodiment of a game piece according to the invention.
Figure 17:
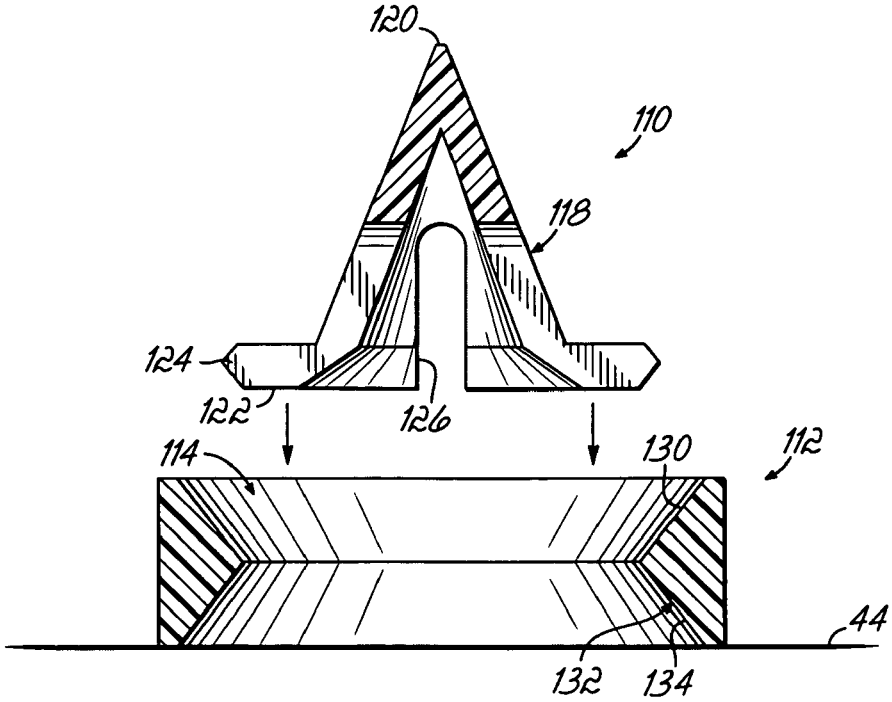
FIGS. 17-20 are views similar to FIGS. 3-6 showing another embodiment of a game-piece being used to capture a transfer object.
Figure 18:
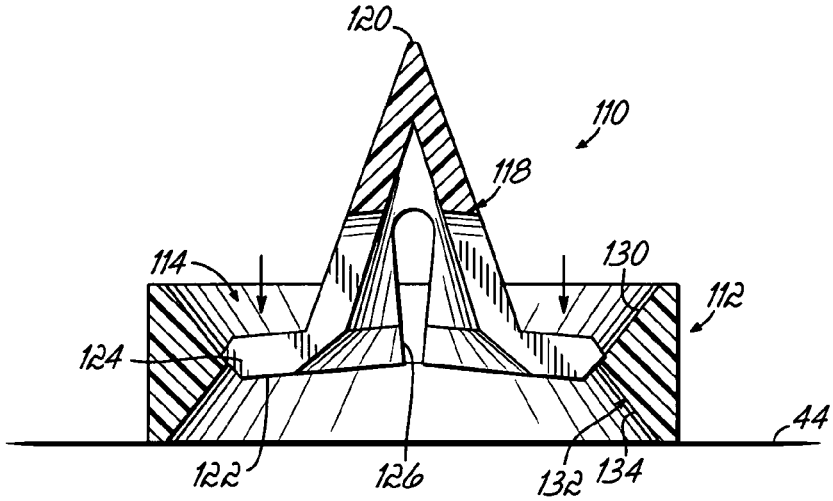
Figure 19:
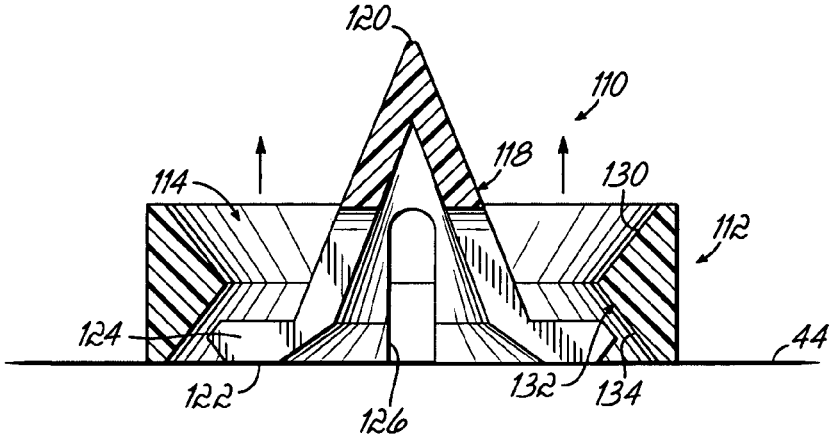
Figure 20:
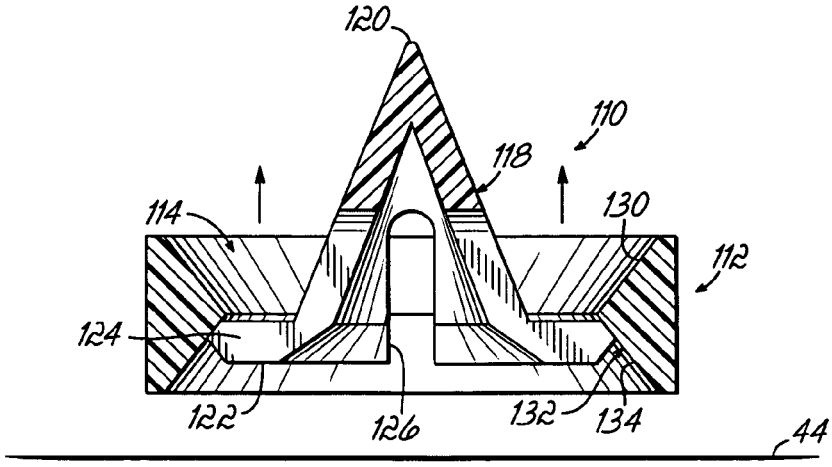
Figure 21:
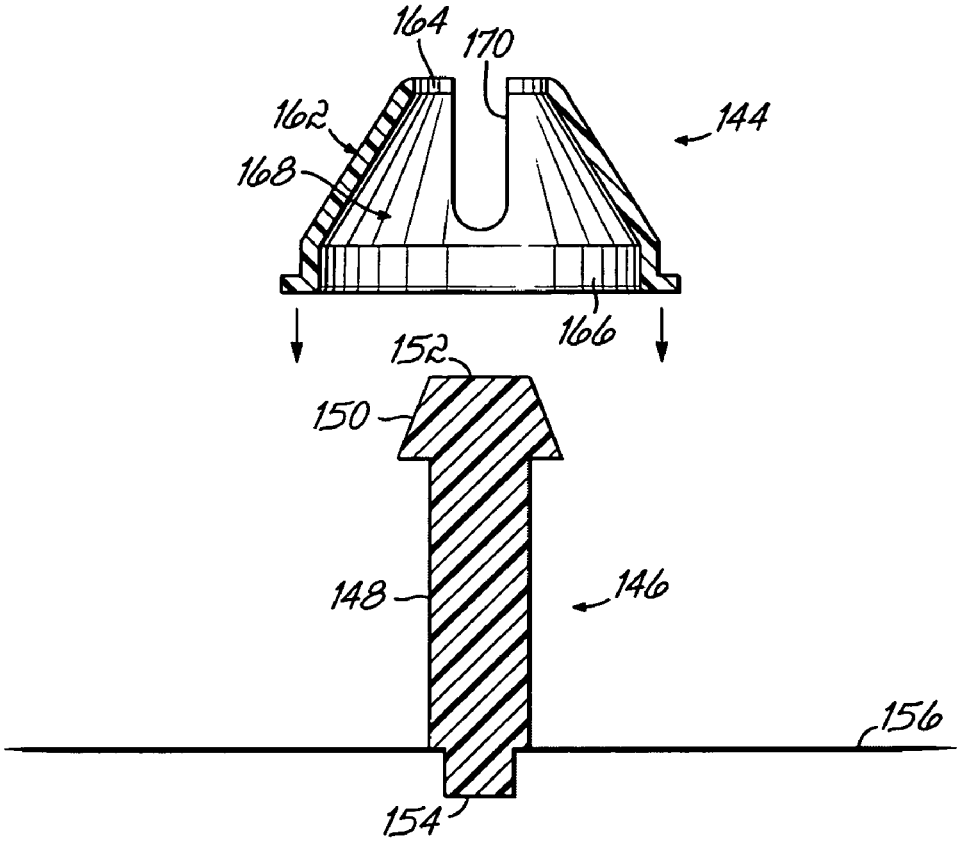
FIGS. 21-24 are views similar to FIGS. 3-6 showing yet another embodiment of a game-piece according to the invention being used to capture a transfer object.
Figure 22:
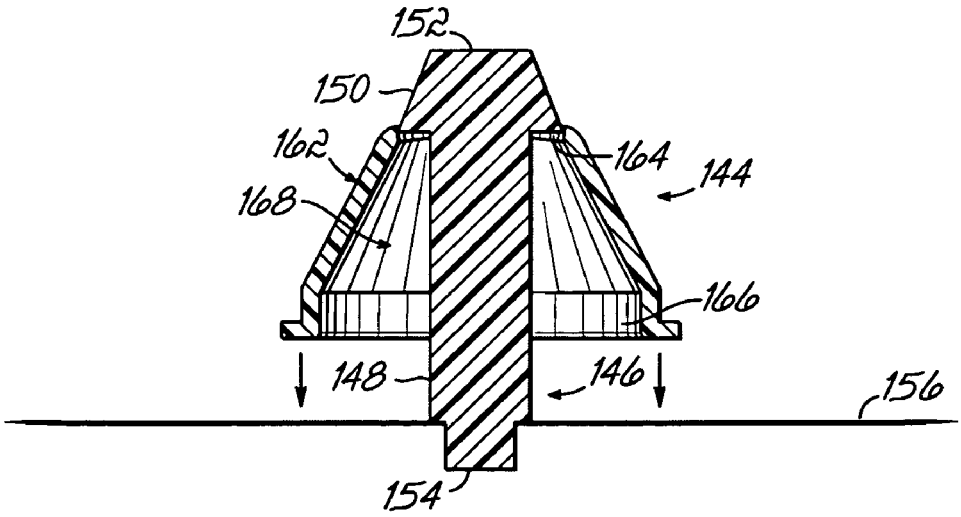
Figure 23:
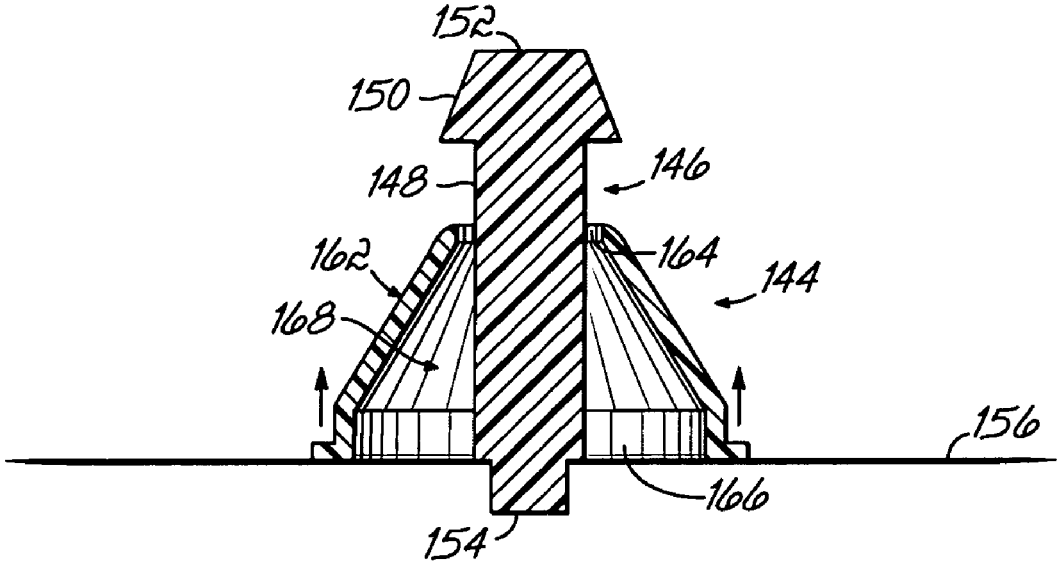

The embodiment shown in FIG. 16 is substantially the same as the embodiment in FIGS. 1 through 9. In this embodiment, however, the outer wall 32 includes one or more openings or windows 98 for aesthetic appeal. The windows 98 extend from the lower end 18 to the upper end 16 such that legs 33 define the outer wall 32. Because the number of windows 98 corresponds to the number of legs 33, the windows 98 also enable multiple game pieces to be nested more closely. In particular, the legs 33 extend slightly outwardly from the exit opening 24 before projecting downwardly and are coupled to an outer ring 100 at the lower end 18. The width of each leg 33 is smaller than a corresponding window 98 such that when a second game piece is placed on top of the game piece 10, the legs of the second game piece can be received in the windows 98.

With reference to FIGS. 17 through 20, a game piece 110 according to another embodiment of the invention is shown. The game piece 110 is designed to pick up and support a transfer object 112 having a central opening 114. As shown, the game piece 110 is substantially conical and the transfer object 112 is ring-shaped. The game piece 110 includes a carrier body 118 having an upper end or apex 120, a lower end 122, and a base section 124 extending outwardly from the lower end 122. One or more slots or gaps 126 extend upwardly from the lower end 122 towards the apex 120 such that the carrier body 118 is flexible.

The base section 124 is sized to pass through the central opening 114 and thereafter support the transfer object 112. More specifically, the base section 124 is sized to engage a sloped portion 130 of an inner wall 132 that defines the central opening 114 of the transfer object 112. When the base section 124 is aligned over the central opening 114 and the game piece 110 is pushed onto the transfer object 112, the sloped portion 130 of the inner wall 132 causes the carrier body 118 to flex. This allows the base section 124 to pass beyond the sloped portion 130 and extend through the central opening 114. The base section 124 then engages a sloped portion 134 of the inner wall 132 and expands back to its initial size. The interaction between the base section 124 and the sloped portion 134 forces the transfer object 112 on top of the base section 124 such that the transfer object 112 is supported by the base section 124.

A second game piece (not shown) may be used to capture the transfer object 112 from the game piece 110. More specifically, the game piece 110 may be adapted to receive a second game piece (not shown) that has a similarly configured carrier body and base section. When the carrier body of the second game piece is pushed on top of the game piece 110, the transfer object 112 is transferred from the base section 124 of the game piece 110 to the base section of the second game piece. The game piece 110, like the other embodiments discussed above, may further be adapted to nest with the second game piece so that the game pieces are stackable.

A game piece 144 according to yet another embodiment of the invention is shown in FIGS. 21 through 24. The game piece 144 is for use with a transfer object 146 having a neck portion 148 and a head portion 150. Although the transfer object 146 is generally pin or rod-shaped, the head portion 150 is wider in diameter than the neck portion 148 and is tapered towards an upper end 152 of the transfer object 146. Additionally, the transfer object 146 further includes a pilot or anchor 154 to secure the object to a game board surface 156.

The game piece 144 is comprised of a carrier body 162 having an upper opening 164, a lower opening 166, and a socket 168 extending between the upper and lower openings 164, 166. The lower opening 166 is larger in diameter than the upper opening 164 such that the socket 168 is substantially conical. The upper opening 164 is sized to engage the neck portion 148 of the transfer object 146, and one or more slots or gaps 170 are provided in the socket 168 such that the upper opening 164 is flexible.

Figure 24:
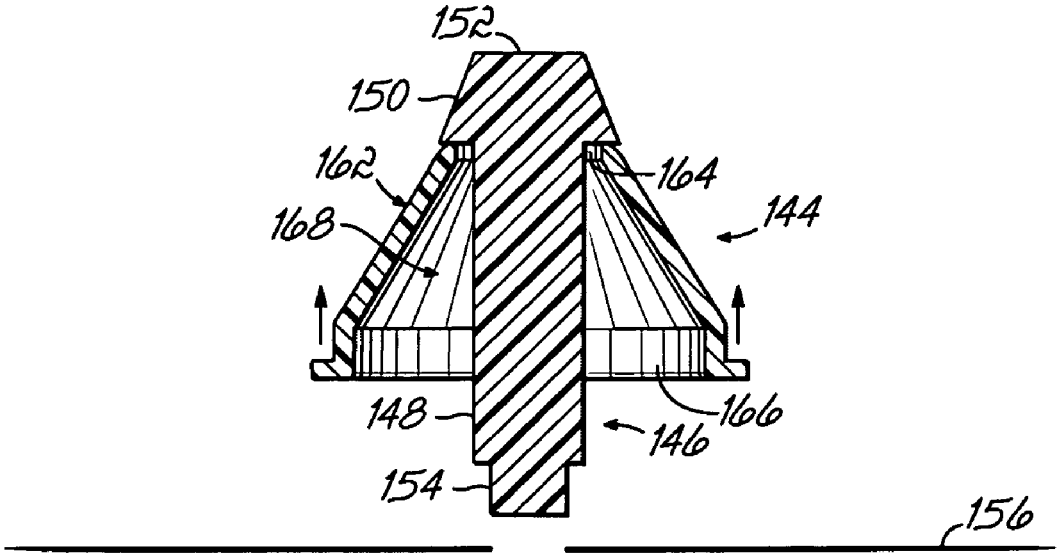

Thus, in use, the game piece 144 is positioned over the transfer object 146 with the upper opening 164 aligned with the head portion 150. When the game piece is pushed upon the transfer object 146, the upper opening 164 engages the head portion 150 and flexes until the head portion 150 extends therethrough. The upper opening 164 then engages the neck portion 148 so that the transfer object 146 is retained by the carrier body 162. If a player raises the game piece 144, the head portion 150 will be prevented from passing back through the upper opening 164 (FIG. 24). Thus, the transfer object 146 will be moved along with the game piece 144.

Like the other embodiments discussed above, a second game piece may be used to capture the transfer object 146 from the game piece 144. In particular, the game piece 144 is adapted to receive a second game piece (not shown) that has a similarly configured socket and upper opening. When the second game piece is pushed over the transfer object 146, the upper opening on the second game piece flexes to allow the head portion 150 to pass therethrough. The upper opening of the second game piece then engages the neck portion 148. If a player raises the second game piece, the transfer object 146 will move as well because the head portion 150 will be prevented from passing back through the upper opening of the second game piece. Thus, the transfer object 146 can be captured from the game piece 144, which may be held in position when the second game piece is moved to another location. To facilitate stacking and transferring the transfer object 146, the game piece 144 is adapted to nest with the second game piece.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A game piece for capturing a spherical transfer object residing on a game board surface, comprising:

a carrier body being axis-symmetric about a central axis, the carrier body having an upper end and a lower end and an inner wall extending downwardly and inwardly from proximate the upper end to proximate the lower end to form a substantially conical socket, the socket having a flexible entry opening proximate the lower end and an exit opening proximate the upper end, the entry opening and the exit opening being axis-symmetric about the central axis, the entry opening sized to allow the spherical transfer object to pass therethrough and into the socket when the entry opening is forced over the spherical transfer object, the inner wall having a first surface configured to support the spherical transfer object above the entry opening and a second surface opposite the first surface, the carrier body further having a substantially conical outer wall extending downwardly and outwardly from proximate the upper end to proximate the lower end and surrounding the inner wall to define a cavity between the second surface of the inner wall and the outer wall;

wherein the cavity has a generally triangular cross-section such that the upper end of a second, similarly-configured game piece may nest substantially within the cavity of the carrier body.

2. The game piece of claim 1, wherein the inner wall includes a flexible member that defines a portion of the entry opening, the flexible member adapted to deflect when contacting the spherical transfer object so as to allow the spherical transfer object to pass through the entry opening.

3. The game piece of claim 2, wherein the inner wall includes a plurality of flexible members that can deflect independently of one another.

4. The game piece of claim 1, wherein the carrier body includes a cut-out portion through the inner wall and the outer wall.

5. The game piece of claim 1, wherein the carrier body further comprises first and second sections directly coupled to each other, each section defining at least a portion of the outer wall.

6. The game piece of claim 5, further comprising a ring member extending around the outer wall to facilitate coupling the first section to the second section.

7. A set of game pieces for capturing a spherical transfer object residing on a game board surface, comprising:

first and second game pieces each having a carrier body axis-symmetric about a central axis, the carrier body having an upper end and a lower end and an inner wall extending downwardly and inwardly from proximate the upper end to proximate the lower end to form a substantially conical socket, the socket having a flexible entry opening proximate the lower end and an exit opening proximate the upper end, the entry opening and the exit opening being axis-symmetric about the central axis, the entry opening sized to allow the spherical transfer object to pass therethrough and into the socket when the entry opening is forced over the spherical transfer object, the inner wall having a first surface configured to support the spherical transfer object above the entry opening and a second surface opposite the first surface, the carrier body further having a substantially conical outer wall extending downwardly and outwardly from proximate the upper end to proximate the lower end and surrounding the inner wall to define a cavity between the second surface of the inner wall and the outer wall;

wherein the cavity has a generally triangular cross-section such that the upper end of the first game piece is configured to nest within the cavity of the second game piece.

8. The set of game pieces of claim 7, further comprising a spherical transfer object configured to pass through the entry opening and be retained within the socket.

9. The set of game pieces of claim 8, wherein the spherical transfer object initially resides within the socket of the first game piece and is transferred from the first game piece to the second game piece when the upper end of the first game piece nests within the cavity of the second game piece.

10. A method for capturing a spherical transfer object residing on a game board surface, comprising the steps of:

positioning a first game piece above the spherical transfer object, the first game piece having a carrier body axis-symmetric about a central axis, the carrier body having an upper end and a lower end and an inner wall extending downwardly and inwardly from proximate the upper end to proximate the lower end to form a substantially conical socket, the socket having a flexible entry opening proximate the lower end and an exit opening proximate the upper end, the entry opening and the exit opening being axis-symmetric about the central axis, the inner wall having a first surface configured to support the spherical transfer object above the entry opening and a second surface opposite the first surface;

forcing the entry opening of the first game piece over the spherical transfer object so that the spherical transfer object passes through the entry opening and thereafter resides within the socket;

positioning a second game piece over the spherical transfer object residing in the first game piece, the second game piece having a carrier body substantially the same as the carrier body of the first game piece, the carrier body further including a substantially conical outer wall extending downwardly and outwardly from proximate the upper end to proximate the lower end and surrounding the inner wall to define a cavity between the second surface of the inner wall and the outer wall, the cavity having a generally triangular cross-section; and forcing the entry opening of the second game piece over the spherical transfer object residing in the first game piece so that the spherical transfer object passes through the entry opening of the second game piece and thereafter resides within the socket of the second game piece and the upper end of the first game piece nests substantially within the cavity of the second game piece.

11. The method of claim 10, wherein the inner wall of the second game piece includes a flexible member that defines a portion of the entry opening, the flexible member adapted to deflect when contacting the spherical transfer object allowing the spherical transfer object to pass through the entry opening.

12. The method of claim 10, further comprising the step of:

removing the second game piece from the first game piece wherein the spherical transfer object continues to reside with the socket of the second game piece.

* * * * *